United States Patent [19]

Kimmich

[11] 4,063,528

[45] Dec. 20, 1977

[54] ARRANGEMENT FOR COLOR MARKING INSULATED ELECTRICAL CONDUCTORS

[75] Inventor: Klaus Kimmich, Stuttgart, Germany

[73] Assignee: International Standard Electric Corporation, New York, N.Y.

[21] Appl. No.: 691,947

[22] Filed: June 1, 1976

[30] Foreign Application Priority Data

July 2, 1976 Germany ..... 2526255
July 5, 1976 Germany ..... 2524572

[51] Int. Cl.[2] ..... B05C 5/02

[52] U.S. Cl. ..... 118/7; 118/625; 118/629; 118/DIG. 21; 307/261; 427/117

[58] Field of Search ..... 118/7, 624, 625, 627, 118/629, 630, DIG. 21; 427/32, 117, 286; 239/3, 15; 307/261; 328/13

[56] References Cited

U.S. PATENT DOCUMENTS

| | | | |
|---|---|---|---|
| 3,482,116 | 12/1969 | James | 307/261 |
| 3,569,841 | 3/1971 | Richman | 307/261 X |
| 3,596,275 | 7/1971 | Sweet | 118/625 X |
| 3,638,612 | 2/1972 | Haise et al. | 118/629 X |
| 3,727,131 | 4/1973 | Puckette | 307/261 X |
| 3,731,655 | 5/1973 | Griesser | 118/DIG. 21 |

FOREIGN PATENT DOCUMENTS

| | | | |
|---|---|---|---|
| 1,034,146 | 6/1966 | United Kingdom | 118/DIG. 21 |

*Primary Examiner*—Mervin Stein
*Attorney, Agent, or Firm*—John T. O'Halloran; Alfred C. Hill

[57] ABSTRACT

In this arrangement a circuit is provided for generating deflection voltages for the coloring material marking the insulation of electrical conductors as the electrical conductors are extruded which compensate for distortions in the shape of color ring insulation markings when large ring spaces or high conductor extrusion speeds are employed. Two spaced spray nozzles are used to provide two streams of color material. These nozzles are disposed on opposite sides of the extruded electrical conductor, each of the spray nozzles provide one half of the color rings. The deflection voltage consists of a rectangular waveform with a semicircular top portion. A high resistance potentiometer is connected between the two spray nozzles with the wiper of the potentiometer connected to a high DC voltage source. Adjustment of the wiper renders the amplitudes of the two streams of color material equal.

10 Claims, 4 Drawing Figures

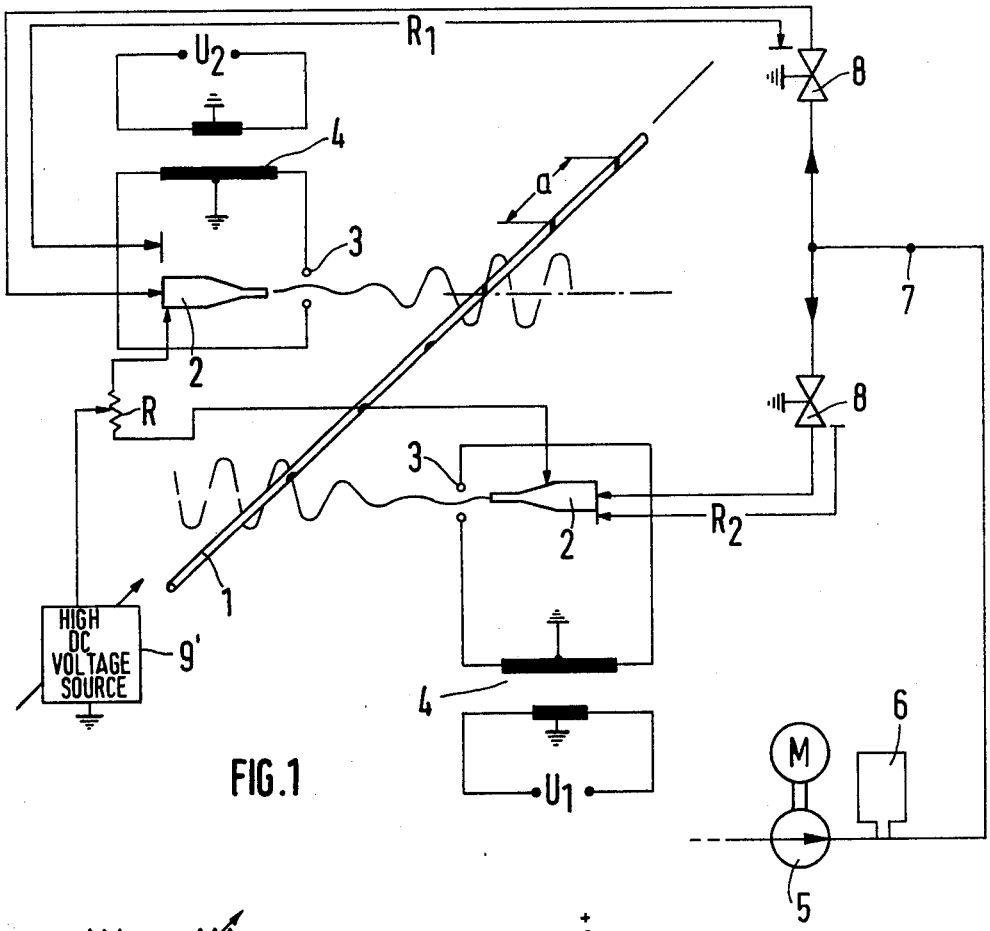
FIG.1
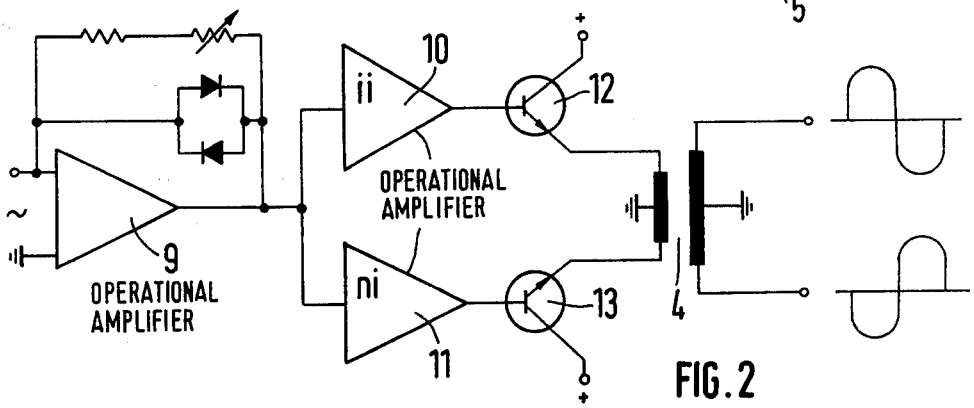
FIG.2
FIG.3a
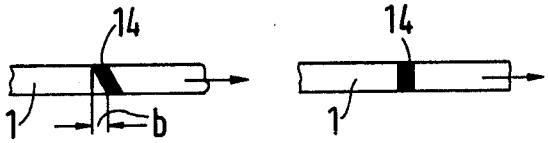
FIG.3b

ARRANGEMENT FOR COLOR MARKING INSULATED ELECTRICAL CONDUCTORS

BACKGROUND OF THE INVENTION

The present invention relates to an apparatus for color marking insulated electrical conductors. The arrangement for marking insulated electrical conductors includes a stream of color material continuously emerging under pressure from a spray nozzle disposed at a right angle to the electrical conductor and is caused to oscillate by a deflection system subjected to a high alternating voltage. The deflection voltage for the stream of color material ensures that the color ring marks are produced at all marking frequencies coming into question.

Such arrangements for color marking insulated electrical conductors are known and have proved good in practice. In the known marking apparatus, the deflection system is subjected to a sinusoidal alternating voltage. This results in a sinusoidal deflection of the stream of color material, which produces, in a known manner, a half ring on the longitudinally advancing extruded insulated electrical conductor at the zero crossing of the sinusoidal oscillation. The production of two ring marks composed of two separately produced half rings functions excellently for a wide range of ring spacings and extruder take-off speeds. Difficulties may be encountered only with very large ring spacings, which correspond to low frequencies of the deflection voltage, and/or at high extruder take-off speeds for the following reason.

To be able to produce the whole spectrum of ring marks at the high extruder take-off speeds of modern extruders insulating the electrical conductor, streams of color material are needed which are deflected at frequencies between about 200 and 2,000 Hz (hertz). At a constant pressure of the color material, the number of wave trains of the deflected color stream between the point of origin, i.e., the deflecting electrodes, and the marking plane varies by a factor of 10 also.

When the number of wave trains of the sinusoidally deflected stream of color material is small, i.e., at a low deflection frequency or with a large ring spacing and/or at a high extruder take-off speed, the conductor, while the stream of color material is passing over it, travels a distance which is not negligible. As a result, the ring mark becomes wider, increasingly oblique, and distorted in the form of two half circles. In addition in the known marking apparatus, the amplitudes of the stream oscillations are not generally equal to each other. One of the reasons for this is, for example, that the spray nozzles have different diameters when a small amount of color material has deposited in one of the nozzles. Another reason may be that the color material in the feed pipe to one spray nozzle is given a charge different from that applied in the other feed pipe, and this may result in different deflection properties.

SUMMARY OF THE INVENTION

An object of the present invention is to provide an arrangement for generating a deflection voltage for the stream of color material which arrangement prevents the above-explained phenomenon, i.e., the inclination of the half ring at low deflection frequencies of the stream of color material.

Another object of the present invention is to provide means whereby the amplitudes of both streams of color material can be simultaneously adjusted to the same magnitude in a simple manner, thereby eliminating the need for complicated individual control of the two stream amplitudes.

A feature of the present invention is the provision that at least at low marking frequencies, the deflection system is subjected to a deflection voltage consisting of rectangles having semicircular top portions thereon.

Another feature of the present invention is the provision that the color material has a conductivity between 0.5 and 2 micromhos per centimeter and that the spray nozzles are interconnected via a potentiometer whose slider or wiper is connected to a voltage source having one terminal grounded and providing a high DC (dirct current) voltage, and that the valves inserted in the pipes coupling the color material to the spray nozzles are grounded.

BRIEF DESCRIPTION OF THE DRAWING

Above-mentioned and other features and objects of this invention will become more apparent by reference to the following description taken in conjunction wih the accompanying drawing, in which:

FIG. 1 shows schematically the apparatus for color marking insulated electrical conductors in accordance with the principles of the present invention;

FIG. 2 shows a basic circuit arrangement for generating the deflection voltage in accordance with the principles of the present invention;

FIG. 3*a* shows part of a conductor with a color ring mark produced with a sinusoidal deflection voltage of low frequency of the prior art, and FIG. 3*b* shows part of a conductor with a ring mark produced with a low-frequency deflection voltage consisting of rectangles having semicircular top portions thereon.

DESCRIPTION OF THE PREFERRED EMBODIMENT

FIG. 1 shows the extruded insulated electrical conductor 1 which is to be provided with colored ring marks at intervals *a* with conductor 1 advancing in the direction of the arrow. The ring mark is formed successively from two half rings each of which is produced by one of the two spray nozzles 2. These spray nozzles 2 are disposed on opposite sides of conductor 1 and spaced from each other a given axial distance such that the amplitude of the second stream of color material is zero when the first half ring passes by the second of spray nozzles 2. The deflection of the streams of colored material is effected by the deflecting-electrode systems 3, which are subjected to high alternating voltages derived from the deflection voltages U1 and U2, respectively, by transformation in high-voltage transformers 4.

From a storage tank (not shown), the color material is transferred, by means of a gear pump 5 driven by a motor M, through a buffer vessel 6 (dashpot) into the pipe 7, from which it can move to spray nozzles 2 after valves 8 have been opened. The color material not hitting conductor 1 is collected in conventional catch devices (not shown) and returned to the storage tank.

The block diagram of FIG. 2 shows the basic circuit arrangement for generating a deflection voltage which is suited to sinusoidally deflect the stream of color material, emerging from spray nozzles 2 at a constant speed, within a wide frequency range in such a way that colored rings are produced on conductor 1. This circuit arrangement includes an operational amplifier 9 employing nonlinear-feedback via a variable resistor and two back-to-back diodes in parallel. The output of the operational amplifier 9 is connected to two further operational amplifiers 10 and 11. Operational amplifier 10 provides an inverted output signal, and operational amplifier 11 provides a non-inverted output signal. A following push-pull power amplifier stage, indicated by transistors 12 and 13, produces from the output signals of the operational amplifiers 10 and 11 high-power signals which are transformed to a high voltage in the high-voltage transformer 12 and made available at the deflecting-electrode systems 3 as the deflection voltage.

The actual waveform of the deflection voltage, an alternating voltage consisting of rectangles having semicircular top portions thereon as shown in FIG. 2, is generated by the nonlinear-feedback operational amplifier 9. Operational amplifier 9 operates as follows. Applied to the input of the operational amplifier is a sinusoidal control voltage whose peak amplitude is considerably larger than the forward voltages of the diodes in the feedback path (example: diode forward voltage 0.5V, amplitude of the sinusoidal control voltage 6–10V). The feedback then has the following effect. At amplitude values of the control voltage which are smaller than the diode forward voltage, the diodes do not contribute to the feedback, i.e., the gain of the operational amplifier 9 is determined only by the variable resistor and can be chosen to be suitably high. At amplitude values of the control voltage which are larger than the diode forward voltage, the feedback is increasingly determined by the diodes, whose resistance decreases with increasing signal amplitude, i.e., the gain decreases.

In the present case, this means that that portion of the sinusoidal control voltage which lies below the diode forward voltage is amplified very strongly, while the portion lying above the diode forward voltage is amplified less strongly and even weakened. Thus, operational amplifier 9 provides an alternating voltage whose shape resembles a rectangle having a semicircular top portion thereon, and whose amplitude is nearly independent of the value of the input voltage after exceeding the diode forward voltage.

As mentioned by way of introduction, deflection voltages of different frequency are needed for the production of colored rings spaced different distances apart, and at different extruder take-off speeds of the conductor. If the sinusoidal control voltage at the input of operational amplifier 9 has, at all frequencies coming into question, an amplitude which is considerably larger than the diode forward voltage, the deflection voltage, too, will have the aforementioned waveform at all frequencies.

However, since this waveform is needed only in the case of deflection voltages with low frequency, as also mentioned by way of introduction, it is advantageous to derive the sinusoidal control voltage in a low-pass filter from an existing square-wave voltage. This has the advantage that at low frequencies — as desired — a deflection voltage is generated whose shape resembles a rectangle having a semicircular top portion thereon, and which turns into a deflection voltage approximating a sinusoidal waveform as the frequency increases.

This is due to the fact that, because of the characteristic of the low-pass filter, the amplitude of the sinusoidal control voltage decreases with increasing frequency. The distortion of the waveform of the sinusoidal control voltage in the nonlinear-feedback operational amplifier 9 decreases with decreasing amplitude of the sinusoidal control voltage. When the amplitude is smaller than the diode forward voltage, there is no distortion because the feedback component is rendered ineffective by the diodes. The output signal of the operational amplifier is then a purely sinusiodal oscillation.

FIG. 3*a* shows what happens if with large ring spacings and/or at a high extruder take-off speed, the colored rings are produced by means of a sinusoidal deflection voltage of low frequency as in the prior art arrangement mentioned above. During the time interval in which the stream of color material, oscillating at a low frequency, passes through the range of the zero amplitude and, consequently, over conductor 1, the latter travels the distance b. Thus, the half ring 14 applied to conductor 1 is oblique.

If, however, a waveform as shown in FIG. 2 is used at low-frequency deflection voltages, the stream of color material, deflected at a low frequency, will pass through the zero-amplitude range much faster as a result of the greater slope steepness. The half ring 14 is no longer inclined, as can be seen in FIG. 3*b*.

FIG. 1 shows the arrangement for adjusting equal amplitudes of color streams. It consists of a high-resistance potentiometer R each of whose terminals is connected to one of spray nozzles 2, while its wiper is connected to a variable high-voltage DC generator 9' which provides a DC voltgae between 0 and 6 kV (kilovolts), for example. The other electrode of the high-voltage generator and the valves 8 are grounded.

Since the color material, in order to be deflectable at all, should have a given conductivity, the color material between the grounded valves 8 and the spray nozzles 2 offers high resistances R1 and R2 across which a voltage appears in the circuit of FIG. 1. By moving the wiper of potentiometer R, different voltages can be applied to the spray nozzles 2 whereby the two streams of color material are given different charges, which normally results in different stream amplitudes. If the stream amplitudes are already different from each other, they can be made equal to one another by adjusting the wiper. As may be seen, this is done in a simple manner and without the need to control the voltages at the spray nozzles 2 individually.

While I have described above the principles of my invention in connection with specific apparatus it is to be clearly understood that this description is made only by way of example and not as a limitation to the scope of my invention as set forth in the objects thereof and in the accompanying claims.

I claim:

1. In an arrangement for color marking a moving insulated electrical conductor by a stream of color material continuously emerging under pressure from a pair of spray nozzles disposed in a given spaced relation with respect to each other along said conductor and on opposite sides of said conductor, each of said streams of color material being caused to oscillate by a deflection system subjected to a deflection voltage, at least a first arrangement to generate said deflection voltage comprising:

a first electronic stage to convert a sinusoidal control voltage to an output voltage consisting of rectangles each having a semicircular top portion;

a second elecronic stage coupled to said first stage to provide said output voltage at the output of said second stage;

a third electronic stage coupled to said first stage to provide an inverted version of said output voltage at the output of said third stage;

a push-pull amplifier circuit coupled to said second and third stages to amplify said output voltage at the output of said second stage and to amplify said inverted version of said output voltage at the output of said third stage; and a high-voltage transformer coupled to said amplifier circuit to step up the voltage of the resultant output voltage of said amplifier circuit to a high voltage and provide said deflection voltage for coupling to said deflection system.

2. A first arrangement according to claim 1, wherein said first stage includes a feedback operational amplifier having a feedback path including a variable resistor and two back-to-back diodes in parallel with each other and said variable resistor.

3. A first arrangment according to claim 2, wherein said second stage includes a non-inverting operational amplifier;

said third stage includes an inverting operational amplifier; and said amplifier circuit includes a transistorized power amplifier stage.

4. A first arrangement according to claim 1, wherein said second stage includes a non-inverting operational amplifier;

said third stage includes an inverting operational amplifier; and said amplifier circuit includes a transistorized power amplifier stage.

5. In said arrangement for color marking according to claim 4, further including a second arrangement to adjust the amplitudes of each of said streams of color material comprising:

a source of high direct current voltage having a first terminal coupled to a ground potential and a second terminal to provide said high voltage;

a potentiometer having one terminal connected to one of said pair of spray nozzles, its other terminal connected to the other of said pair of spray nozzles and a wiper connected to said second terminal, said wiper enabling simultaneous adjustment of the amplitude of each of said streams of color material; and a pair of valves each coupled to a different one of said pair of spray nozzles to control the flow of said color materials thereto, each of said pair of valves being coupled to said ground potential.

6. A second arrangement according to claim 5, wherein said color material has a conductivity between 0.5 and 2 micromhos per centimeter.

7. In said arrangement for color marking according to claim 1, further including a second arrangement to adjust the amplitudes of each of said streams of color material comprising:

a source of high direct current voltage having a first terminal coupled to a ground potential and a second terminal to provide said high voltage;

a potentiometer having one terminal connected to one of said pair of spray nozzles, its other terminal connected to the other pair of spray nozzles and a wiper connected to said second terminal, said wiper enabling simultaneous adjustment of the amplitude of each of said streams of color material; and a pair of valves each coupled to a different one of said pair of spray nozzles to control the flow of said color material thereto, each of said pair of valves being coupled to said ground potential.

8. A second arrangement according to claim 7, wherein said color material has a conductivity between 0.5 and 2 micromhos per centimeter.

9. In an arrangement for color marking a moving insulated electrical conductor by a stream of color material continuously emerging under pressure from a pair of spray nozzles disposed in a given spaced relation with respect to each other along said conductor and on opposite sides of said conductor, each of said streams of color material being caused to oscillate by a deflection system subjected to a deflection voltage, an arrangement to adjust the amplitudes of each of said streams of color material comprising:

a source of high direct current voltage having a first terminal coupled to a ground potential and a second terminal to provide said high voltage;

a potentiometer having one terminal connected to one of said pair of spray nozzles, its other terminal connected to the other of said pair of spray nozzles and a wiper connected to said second terminal, said wiper enabling simultaneous adjustment of the amplitude of each of said streams of color material; and a pair of valves each coupled to a different one of said pair of spray nozzles to control the flow of said color material thereto, each of said pair of valves being coupled to said ground potential.

10. An arrangement to adjust the amplitudes of each of said streams of color material according to claim 9, wherein said color material has a conductivity between 0.2 and 2 micromhos per centimeter.

* * * * *